United States Patent [19]

Koehler

[11] 4,408,813

[45] Oct. 11, 1983

[54] MULTIPLE OUTLET AND COVER THEREFOR

[75] Inventor: Rudolph Koehler, Willowdale, Canada

[73] Assignee: Noma Canada Ltd., Scarborough, Canada

[21] Appl. No.: 299,405

[22] Filed: Sep. 4, 1981

[51] Int. Cl.[3] ..... H01R 13/44

[52] U.S. Cl. ..... 339/38

[58] Field of Search ..... 339/36, 38, 39, 44

[56] References Cited

U.S. PATENT DOCUMENTS

| | | | |
|---|---|---|---|
| 2,407,894 | 9/1946 | Miller | 339/39 |
| 2,993,189 | 6/1961 | Schelke et al. | 339/59 R |
| 3,107,132 | 10/1963 | Smith | 339/36 |
| 3,389,367 | 6/1968 | Schwartz | 339/38 |
| 4,257,659 | 3/1981 | Gibbs | 339/36 |

FOREIGN PATENT DOCUMENTS

| | | | |
|---|---|---|---|
| 2742655 | 3/1979 | Fed. Rep. of Germany | 339/36 |

*Primary Examiner*—Joseph H. McGlynn
*Assistant Examiner*—Paula Austin
*Attorney, Agent, or Firm*—Swabey, Mitchell, Houle, Marcoux & Sher

[57] ABSTRACT

A cube tap has a cover secured thereto by a flexible tether which permits a user to seal off outlets in different faces of the cube tap. The cube tap, cover and tether may be unipartitely molded.

7 Claims, 4 Drawing Figures

FIG.1.
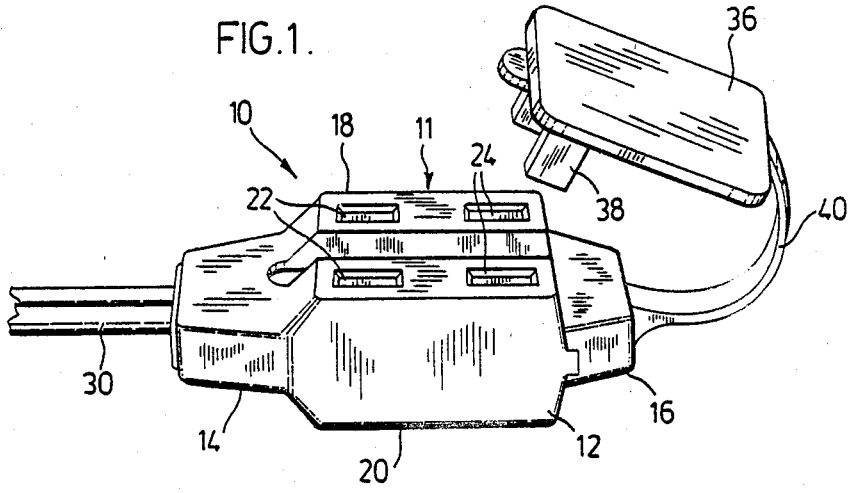
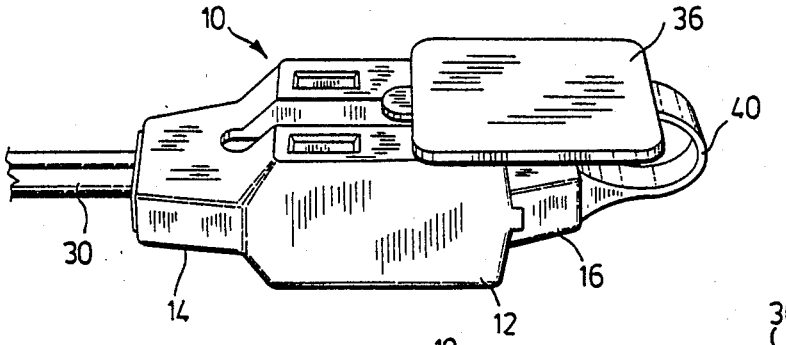
FIG.2.
FIG.3.
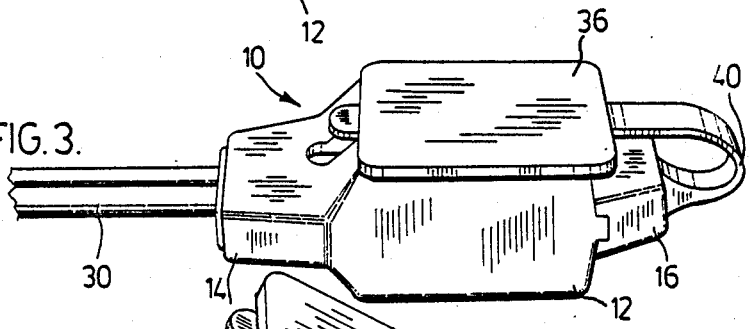
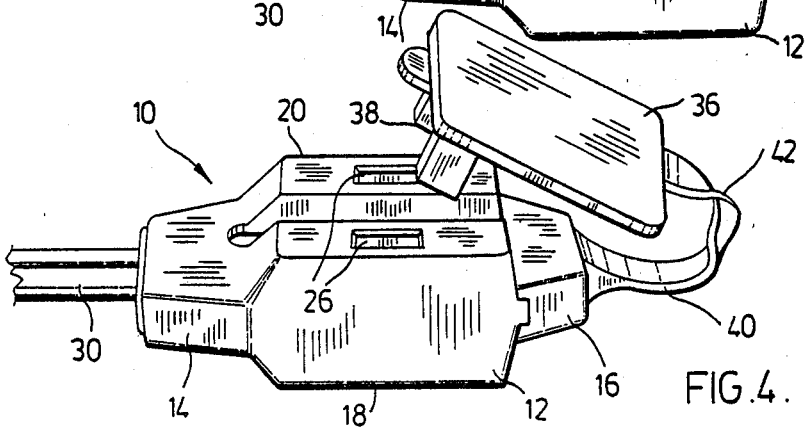
FIG.4.

MULTIPLE OUTLET AND COVER THEREFOR

FIELD OF INVENTION

This invention relates to wiring devices. It particularly relates to a multiple outlet device commonly known as a cube tap, and to the provision of a cover therefor to prevent access to one or more of the outlets.

BACKGROUND OF INVENTION

It is generally known to provide insulating covers for electrical outlet devices. Such covers may be simple, comprising a disc of dielectric material having tabs dependent from one face thereof shaped and spaced to engage prong openings forming an electrical outlet of the device so as to be frictionally retained therein. A disadvantage of this type of cover is that it is readily misplaced. It is further known to attach covers of the above type to the cord of a cord set, one such proposal therefor being contained in U.S. Pat. No. 3,389,367 to Schwartz, (June, 1968). Again such covers are readily detached and misplaced. In accordance with the above proposal, where it is desired to cover outlets in two opposed faces of the cube tap, a cover for each face is provided. The covers are integrally connected by comparatively thick plastic members having live hinge portions formed therein.

Still other cube taps having covers are known, these being of varying degrees of complexity involving a multiplicity of parts generally permitting the cover to slide in relation to the cube tap.

It is an object of this invention to provide a cube tap having a removable cover and a flexible tether therefor which is integrally connected to the housing of the cube tap.

It is a further object of this invention to provide a cube tap as aforesaid wherein the one cover may readily engage outlet openings formed in different faces of the cube tap.

It is a further object of the invention to provide a cube tap wherein the housing thereof, the cover and the tether are susceptible to being unipartitely molded, i.e. molded as a single piece or component, thereby providing economic advantage.

It is yet another object of the invention to provide a cube tap which meets and surpasses current safety standards in regard thereto.

SUMMARY OF INVENTION

In accordance with a broad aspect of my invention, a cube tap comprises an insulating housing having electrical outlets located in different faces therein, a removable cover for covering an outlet in one face and a flexible tether integrally connecting the cover to the cube tap, permitting the cover to rotate relative to the cube tap for covering an outlet in another face.

Preferably the flexible tether is self supporting, being unipartitely formed with at least the cover and preferably also with the housing of the device.

In accordance with a preferred aspect of my invention the tether is a relatively thin strip of plastic material, for example polypropylene. I find such material in relatively thick section such as in the housing of the cube tap to be sufficiently hard and inflexible to resist the penetration of a reverse polarized plug blades into the housing, and yet sufficiently flexible in thin sections as in the tether, to permit the desired degree of movement of the cover.

The invention is embodied in an extension cord assembly comprising a cord connector having at one end thereof a cube tap; and a cover therefor secured to the cube tap by a flexible tether, the tether and cord connector locating at opposite ends of the cube tap.

These objects and aspects and still others of my invention will become more clear from a consideration of the following description of a preferred embodiment of the invention, taken in conjunction with the accompanying drawing, and the claims appended hereto.

BRIEF DESCRIPTION OF THE DRAWINGS

In the drawings:

FIG. 1 is a perspective view of the multiple outlet end of a cord set embodying my invention;

FIG. 2 is a similar view of FIG. 1, and shows the cover engaged in a first position;

FIG. 3 is a similar view of FIG. 1 and shows the cover engaged in a second position, and FIG. 4 is a view of the reverse face of the cord set of FIG. 1, and shows the cover engageable in a third position.

DESCRIPTION OF PREFERRED EMBODIMENT

Referring now to the drawings in detail, an entension cord set, the plug end of which is not illustrated, is denoted by the numeral 10. Cord set 10 comprises a cube tap 11 having an insulating housing 12 including opposed axial ends 14,16 and opposed faces 18,20 generally extending between the ends. Face 18 has a first pair of transversely located openings 22 therein shaped and spaced to receive the prongs of a polarized electrical plug therein, the opening for the neutral prong of the plug being made marginally greater than that for the line prong. A second pair of prong openings 24 axially spaced and aligned with openings 22 is also provided in face 18. A third pair of transversely located prong openings 26 is provided in face 20, as seen in FIG. 4. The pairs of prong openings may in the subsequent description be referred to as outlet openings.

Extension cord set 10 further includes a cord conductor 30 which enters housing 12 at axial end 14 thereof. Although not shown cord conductor 30 may be assumed to be electrically connected in a conventional manner to line and neutral busses which underlie the prong openings 22, 24, 26 and provide contacts for plug prongs inserted into the openings. As thus for described extension cord set 10 is well known in commerce.

Cube tap 11 includes an insulating cover 36 having a pair of tabs 38 dependent therefrom transversely spaced and shaped so as to be engageable in any of the outlet openings 22, 24, 26 without regard to polarity, and frictionally retained therein, tabs 38 and each outlet opening together forming a complementary means for releasably securing insulating cover 36 to housing 12. A flexible tether 40 interconnects the end 16 of the cube tap 11 remote from the end of entry of cord connector 30 into the cube tap, whereby the cord connector will not interfere with the function of the tether as will be further described.

In using extension cord set 10 it is normally desired that all outlet openings but one be covered. In cube tap 11 illustrated wherein there is provided an adjacent pair of outlet openings 22 and 24 in face 18, and a single outlet opening 26 is opposed face 20, the adjacent pair of outlet openings will normally be covered, as shown particularly in FIG. 3. Cover 36 is therefore axially elongated so that when the outlet opening remote from the tether is covered, i.e. opening 22, the adjacent opening will also be covered. For user convenience it is generally desirable that the complementary means for releasably securing the cover 36 to the housing 12 in its normal mode of use, here tabs 38 and openings 22, be maintained in approximate axial alignment when the cover is not engaged. For this purpose tether 40 is made relatively stiff in transverse directions, being preferably in the form of a thin strip of flexible, self supporting material having its width contained in transverse planes.

At other times it may be desired that two outlet openings be uncovered, or conversely that only one outlet opening be covered. Flexible tether 40 is preferably formed with no discontinuity therein, whereby it may adopt any reasonable radius of curvature and be in addition axially twisted about 180°, shown at 42. This permits the covering of outlet opening 24 in face 18, whereby the uncovered outlet openings 22,26 locate on different faces of cube tap 11, or alternatively the covering of outlet opening 26 in face 20, whereby the uncovered outlet openings 22,24 locate in the same face 18 of the cube tap.

In many jurisdictions it is required that outlets be polarized so that a plug connector may not be inserted into the outlet in a reversed polarized manner. However, where the housing of the outlet is moulded in a resilient material it is often found that it will deform to a sufficient degree to permit the plug connector to be inserted in the reverse manner. It has been heretofore proposed to provide a relatively non-resilient barrier strip to overlie the line contacts of the housing so as to prevent the passage of the neutral prong of the plug connector therethrough. It will be appreciated that this requires additional manufacturing and assembly steps, thus increasing the cost of the cube tap. Housing 12 may be molded in a relatively rigid plastic material which will resist deformation and effectively preclude the revised insertion of a plug connection, polypropylene being found suitable. I find this material to be particularly advantageous both in providing a rigid housing 12, and also when in thin cross section a tether 40 of sufficient flexibility to permit the desired movement of cover 36. Expediently, housing 12, tether 40 and cover 36 may be molded unipartitely to provide a polarized multiple outlet meeting present day safety standards in North America. Dielectric materials other than polypropylene may of course be found to be suitable for use in this aspect of the invention.

I claim:

1. A cube tap comprising:

an insulating housing having a pair of generally opposed ends respectively defining the axial ends of said housing;

a pair of generally opposed side faces extending between said ends;

a plurality of electrical contacts contained within said housing;

inlet conductors secured to said housing at one axial end thereof and being electrically connected to said electrical contacts;

a pair of transversely spaced prong openings one said side face having a first pair of prong openings therein adjacent the one axial end of said housing and a second pair of prong openings adjacent the other axial end;

the other said side face having a pair of prong openings therein, said prong openings being adapted to receive the prongs of an electrical plug connector within said housing to contact said electrical contacts;

an insulating cover having a pair of tabs projecting from one side thereof, and a flexible tether integrally connecting said cover to said cube tap at the axial end thereof remote from said inlet conductors, said tether permitting said tabs to engage in any said pair of prong openings, said tabs located on said cover such that when engaged in said second pair of prong openings said first pair of prong openings is uncovered, and when engaged in said first pair of prong openings said first and second pair of prong openings are covered.

2. A cube tap as defined in claim 1 wherein said tether, said cover and said housing are unipartitely molded.

3. A cube tap as defined in claim 2 wherein said tether comprises a thin strip permitting the cover to be axially twisted thereabout through at least 180°.

4. A cube tap as claimed in claim 3 wherein said thin strip in its untwisted condition is oriented with its width contained in planes parallel to said opposed side faces.

5. A cube tap as defined in claim 2, 3 or 4 wherein said tether is formed without any substantial discontinuity in the cross section thereof.

6. A cube tap as defined in claim 2, 3 or 4 wherein said housing, said cover and said tether are unipartitely molded in polypropylene.

7. An electrical extension cord having at one end thereof a cube tap as defined in claim 2, 3 or 4, said inlet conductors comprising the wire conductors of said extension cord.

* * * * *